US012490804B2

(12) United States Patent
Altrogge et al.

(10) Patent No.: US 12,490,804 B2
(45) Date of Patent: Dec. 9, 2025

(54) SOLE WITH VARIABLE DAMPING PROPERTIES

(71) Applicant: ON CLOUDS GMBH, Zürich (CH)

(72) Inventors: Nils Arne Altrogge, Zürich (CH); Johannes Voelchert, Zürich (CH); Keivn Dellion, Zürich (CH); Martin Rüegg, Zürich (CH); Ilmarin Heitz, Zürich (CH); Renaud Despots Allaire, Zürich (CH)

(73) Assignee: ON CLOUDS GMBH, Zurich (CH)

( * ) Notice: Subject to any disclaimer, the term of this patent is extended or adjusted under 35 U.S.C. 154(b) by 15 days.

(21) Appl. No.: 18/273,823

(22) PCT Filed: Jan. 13, 2022

(86) PCT No.: PCT/EP2022/050647
§ 371 (c)(1),
(2) Date: Jul. 24, 2023

(87) PCT Pub. No.: WO2022/161785
PCT Pub. Date: Aug. 4, 2022

(65) Prior Publication Data

US 2024/0298745 A1 Sep. 12, 2024

(30) Foreign Application Priority Data

Jan. 29, 2021 (CH) ..... 00088/21

(51) Int. Cl.
*A43B 13/18* (2006.01)

(52) U.S. Cl.
CPC ..... *A43B 13/186* (2013.01); *A43B 13/181* (2013.01)

(58) Field of Classification Search
CPC ..... A43B 13/181; A43B 13/18; A43B 13/206; A43B 7/088; A43B 7/08; A43B 7/10
See application file for complete search history.

(56) References Cited

U.S. PATENT DOCUMENTS 4,638,577 A 1/1987 Riggs
6,675,500 B1 1/2004 Cadamuro
(Continued)

FOREIGN PATENT DOCUMENTS

CH 715 590 A1 5/2020
CN 2543378 Y 4/2003
(Continued)

OTHER PUBLICATIONS

Hope, A., "Adidas Climacool Seduction—New Colorways," Sneaker News, (2016) May 20, https://sneakernews.com/2012/03/29/adidas-climacool-seduction (12 pp.).
(Continued)

*Primary Examiner* — Clinton T Ostrup
*Assistant Examiner* — Brianna T. Duckworth
(74) *Attorney, Agent, or Firm* — Pauley Erickson & Swanson

(57) ABSTRACT

A sole for a running shoe including an elastic midsole with a base surface, which delimits the midsole opposite the vertical direction of the midsole, and a surface, which delimits the midsole in the vertical direction. The midsole is divided into a heel region, a central foot region, and a front foot region, and includes multiple channels which run in the transversal direction of the midsole and are arranged one behind the other in the longitudinal direction of the midsole. Each of the channels has an elongated contour in the cross-section along a cross-sectional plane in the longitudinal direction of the midsole and perpendicularly to the transverse direction of the midsole, and each channel has a main longitudinal axis in the cross-section along the cross-sectional plane in the longitudinal direction and perpendicularly to the transversal direction. The acute angle formed between the main longitudinal axis and the base surface of at least one channel arranged in the heel region is greater
(Continued)

than the acute angle formed between the base surface and the main longitudinal axis of at least one channel arranged in the central foot region and/or in the front foot region.

18 Claims, 5 Drawing Sheets

(56) References Cited

U.S. PATENT DOCUMENTS

| | | | | |
|---|---|---|---|---|
| 2006/0201028 | A1* | 9/2006 | Chan | A43B 13/141 36/28 |
| 2008/0163511 | A1* | 7/2008 | Dean | A43B 21/26 36/35 R |
| 2009/0049716 | A1* | 2/2009 | Romero | A43B 7/08 36/3 R |
| 2010/0223810 | A1* | 9/2010 | Lekhtman | A43B 13/181 36/27 |
| 2012/0174444 | A1 | 7/2012 | Besanceney, III et al. | |
| 2014/0250720 | A1 | 9/2014 | Miner et al. | |
| 2016/0183632 | A1 | 6/2016 | Scofiled et al. | |
| 2017/0000213 | A1* | 1/2017 | Mason | A43B 13/187 |
| 2017/0367438 | A1 | 12/2017 | Del Biondi et al. | |
| 2018/0289105 | A1 | 10/2018 | Hatfiled et al. | |
| 2019/0365032 | A1 | 12/2019 | Kendall et al. | |
| 2020/0253327 | A1 | 8/2020 | Fujita | |
| 2024/0298744 | A1 | 9/2024 | Rüegg et al. | |

FOREIGN PATENT DOCUMENTS

| | | | |
|---|---|---|---|
| CN | 202760304 | U | 3/2013 |
| CN | 203841197 | U | 9/2014 |
| CN | 203873105 | U | 10/2014 |
| CN | 105411095 | A | 3/2016 |
| CN | 105433510 | A | 3/2016 |
| CN | 105476176 | A | 4/2016 |
| CN | 205125228 | U | 4/2016 |
| CN | 104824906 | B | 5/2016 |
| CN | 105768347 | A | 7/2016 |
| CN | 205848826 | U | 1/2017 |
| CN | 107772637 | A | 3/2018 |
| CN | 107969754 | A | 5/2018 |
| DE | 34 40 206 | A1 | 5/1985 |
| DE | 698 09 474 | T2 | 8/2003 |
| DE | 20 2004 012 472 | U1 | 10/2004 |
| DE | 695 33 837 | T2 | 4/2005 |
| DE | 20 2005 007 867 | U1 | 8/2005 |
| DE | 10 2009 054 617 | A1 | 6/2011 |
| DE | 10 2010 055 727 | A1 | 6/2011 |
| DE | 20 2014 003 016 | U1 | 4/2014 |
| EP | 0 189 642 | A1 | 8/1986 |
| EP | 1 447 020 | A1 | 8/2004 |
| EP | 1 824 353 | A1 | 8/2007 |
| EP | 2 700 325 | A1 | 2/2014 |
| EP | 3 117 732 | A1 | 1/2017 |
| EP | 3 379 963 | A1 | 10/2018 |
| EP | 3 484 320 | A1 | 5/2019 |
| EP | 3 648 628 | A1 | 5/2020 |
| ES | 2 354 142 | A1 | 3/2011 |
| FR | 2 695 809 | A1 | 3/1994 |
| GB | 2554949 | A | 4/2018 |
| JP | H07-100002 | A | 4/1995 |
| JP | 2005-218543 | A | 8/2005 |
| KR | 10-0584527 | B1 | 5/2006 |
| KR | 10-2009-0124479 | A | 12/2009 |
| KR | 10-2010-0125083 | A | 11/2010 |
| KR | 10-2012-0083654 | A | 7/2012 |
| WO | WO 2006/065047 | A1 | 6/2006 |
| WO | WO 2016/184920 | A1 | 11/2016 |
| WO | WO 2017/089406 | A1 | 6/2017 |
| WO | WO 2017/145131 | A1 | 8/2017 |
| WO | WO 2018/011030 | A1 | 1/2018 |
| WO | WO 2019/008453 | A1 | 1/2019 |
| WO | WO 2019/214814 | A1 | 11/2019 |
| WO | WO 2022/161785 | A1 | 8/2022 |
| WO | WO 2022/161786 | A1 | 8/2022 |

OTHER PUBLICATIONS

Betschart, B., "Climacool Seduction-officially unvelied," Sneaker Files—Latest Sneaker News, Release Dates, Where to Buy, (2016) May 23, https://www.sneakerfiles.com/adidas-climacool-seduction-officially-unveiled (12 pp.).

EPO (Rijswijk, NL), English language version of the International Search Report, Form PCT/ISA/210, for International Application PCT/EP2022/050647, Apr. 21, 2022 (2 pages).

* cited by examiner

SOLE WITH VARIABLE DAMPING PROPERTIES

CROSS REFERENCE TO RELATED APPLICATION

This application is a National Phase filing in the United States, under 35 USC § 371, of PCT International Patent Application PCT/EP2022/050647, filed on 13 Jan. 2022 which claims the priority of Swiss Patent Application CH 00088/21, filed 29 Jan. 2021.

The above-referenced applications are hereby incorporated by reference herein in their entirety and are made a part hereof, including but not limited to those portions which specifically appear hereinafter.

BACKGROUND OF THE INVENTION

Field of the Invention

The present invention relates to the field of footwear technology, in particular to a sole for a running shoe.

Discussion of Related Art

A plurality of running shoes with different cushioning systems is known in the prior art. Sports and leisure shoes with soles, which have a gel core in the heel area for ensuring a vertical cushioning when treading are widespread. Improvements to the vertical cushioning properties were furthermore attained in that individual spring elements were attached in the heel area between outsole and insole.

Even though the vertical cushioning properties of the shoes is improved by means of the above-mentioned soles, a satisfactory cushioning of forces acting horizontally on the sole and the shoe cannot be attained. Forces with a large horizontal component are additionally reinforced in particular on far-off routes and represent one of the main causes for frequently occurring knee and hip joint pain due to a lack of sufficient cushioning.

A sole is known from WO 2016 184 920 by the applicant, which has segmented and groove-shaped elements, which protrude downwards and are open on the side. Under the effect of the forces occurring when running, the groove-shaped elements are vertically as well as horizontally deformable until their lateral openings are closed. Due to this horizontal deformability, forces acting horizontally on the sole and the shoe, for example when running on sloping terrain, can also be cushioned efficiently, and a high strain on the joints, in particular the knees and the hip, can be avoided thereby.

SUMMARY OF THE INVENTION

In the case of soles comprising segmented, groove-shaped elements, which protrude downwards and are open on the side, fatigue of the material can occur in the case of longer usage time depending on the used sole material, so that cushioning decreases on the one hand and the lateral openings of the groove-shaped elements are irreversibly deformed on the other hand because the elastic properties of the material can get lost after longer usage time. In the case of the sole known from WO 2016 184 920, the groove-shaped elements are furthermore in each case present as individual elements, which protrude from the sole. Depending on weight and foot position of the wearer, this can result in an irregular closure of the lateral openings, whereby the wearer can experience a floating effect because the respective upper and lower layers of the groove-shaped element do not come to rest on one another exactly but can be spatially shifted relative to one another, for example in the transverse direction of the sole, thus perpendicularly to the longitudinal direction or running direction, respectively.

It has furthermore been shown that the greatest cushioning effect is necessary in the heel area of the sole because the runner uses the heel to establish first contact with the ground when running. In contrast, only a significantly lower cushioning effect is required in the forefoot area. It has even been found that cushioning structures in the forefoot area can have negative effects. Even though a cushioning can be attained when treading by means of cushioning structures in the forefoot area, a runner has to overcome the elasticity of the cushioning structures when pushing off, which occurs virtually completely via the forefoot area, whereby force gets lost, which cannot be used for pushing off per se.

The present invention is based on the general problem of further developing the prior art in the area of running shoe soles and to preferably completely or partially overcome the disadvantages of the prior art. In advantageous embodiments, a sole which, on the one hand, can cushion forces acting horizontally on the sole and the shoe when running but which, on the other hand, does not show any or at least lower fatigue of the material even in the case of a longer usage time, is provided. The occurrence of a floating effect is avoided in further advantageous embodiments. In some advantageous embodiments, the cushioning effect in the heel area is increased compared to the prior art, while compared to heel area a lower cushioning effect is provided in the forefoot area, so that significantly less force gets lost when pushing off, and said force is available virtually completely for the process of pushing off.

The general object is solved by means of a sole according to the independent claim. Further advantageous embodiments follow from the dependent claims as well as the description and the drawings.

In a first aspect, the general technical problem is solved by means of a sole for a running shoe comprising an elastic midsole. The sole thereby has a base surface, which delimits the midsole opposite to the vertical direction of the midsole, and a top surface, which delimits the midsole in the vertical direction. It is understood that the base surface faces the ground, and the top surface faces the foot of the wearer or the insole, respectively, when running, i.e. in the operative state. The midsole is thereby divided into a heel area, a midfoot area, and a forefoot area. The person skilled in the art understands thereby that these areas are arranged one behind the other in the longitudinal direction, i.e., in the running direction, and that in particular the midfoot area is arranged between the heel area and the forefoot area. The midsole additionally has several channels, which extend in the transverse direction of the midsole and which are arranged one behind the other in the longitudinal direction of the midsole. Their sides are preferably open laterally, i.e., on the lateral and medial side of the midsole. The channels thereby each have an elongated contour in the cross section along a cross-sectional plane in the longitudinal direction of the midsole and perpendicularly to the transverse direction of the midsole. Each channel thereby has a main longitudinal axis in the cross section along the cross-sectional plane in the longitudinal direction and perpendicularly to the transverse direction. The acute angle between the main longitudinal axis and the base surface of at least one channel arranged in the heel area is thereby greater than the acute angle between the base surface and the main longitudinal axis of at least one channel arranged in the midfoot area and/or in the forefoot area. It has been shown that a significantly increased cushioning effect can be attained in the heel area due to the elongated contour of the channel and due to the fact that the acute angle between the base surface and the main longitudinal axis of at least one channel is greater in the heel area than in the case of a channel in the midfoot area and/or in the forefoot area. Due to the smaller acute angles between the base surface and the main longitudinal axis, a lower cushioning effect is additionally attained in the forefoot area and/or in the midfoot area, which has the effect that when pushing off, which virtually takes place completely via the forefoot area and optionally the midfoot area, hardly any energy gets lost due to the cushioning. The increased acute angle of the channel or of the channels, respectively, in the heel area furthermore has the effect that not only a vertical cushioning is attained, but also a large horizontal cushioning of the forces, which act horizontally when running. All channels in the heel area of the midsole preferably have a greater acute angle between the base surface and the respective main longitudinal axis thereof than all channels in the forefoot area and/or in the midfoot area.

The feature of the acute angle between the main longitudinal axis of a channel and the base surface of the midsole can additionally be replaced by the obtuse angle between the main longitudinal axis of the respective channel and the perpendicular channel line through the center point of the respective channel. The perpendicular channel line therefore extends through the center point of the channel and is perpendicular to the base surface of the midsole or intersects the latter essentially at an angle of 90°, respectively. The person skilled in the art understands that the point of intersection in the case of a curved base surface of the midsole can be defined by the tangent to the midsole at the point of the intersection of the midsole with the perpendicular channel line. In this case, the obtuse angle between the main longitudinal axis and the respective perpendicular channel line of at least one channel arranged in the heel area is thereby also greater than the obtuse angle between the respective perpendicular channel line and the main longitudinal axis of at least one channel arranged in the midfoot area and/or in the forefoot area. In the case of all of the embodiments described here, the feature of the acute angle between the main longitudinal axis of a channel and the base surface of the midsole can thus be replaced by the feature of the obtuse angle between the main longitudinal axis of the respective channel and the perpendicular channel line of the respective channel. The person skilled in the art understands that an obtuse angle lies between 90° and 180° and an acute angle lies between 0° and 90°.

One aspect of the invention thus additionally relates to a sole for a running shoe comprising an elastic midsole. Such a sole thereby has a base surface delimiting the midsole opposite to the vertical direction of the midsole and a top surface delimiting the midsole in the vertical direction. The midsole is thereby divided into a heel area, a midfoot area, and a forefoot area. The midsole additionally has several channels, which extend in the transverse direction of the midsole and which are arranged one behind the other in the longitudinal direction of the midsole. They are preferably open on the side, i.e., on the lateral and the medial side of the midsole. The channels thereby each have an elongated contour in the cross section along a cross-sectional plane in the longitudinal direction of the midsole and perpendicularly to the transverse direction of the midsole. Each channel thereby has a main longitudinal axis in the cross section along a cross-sectional plane in the longitudinal direction and perpendicularly to the transverse direction. The obtuse angle between the main longitudinal axis and the respective perpendicular channel line of at least one channel arranged in the heel area is thereby greater than the obtuse angle between the respective perpendicular channel line and the main longitudinal axis of at least one channel arranged in the midfoot area and/or in the forefoot area. The perpendicular channel line of a channel therefore extends through the center point of the respective channel and is perpendicular to the base surface of the midsole. The center point of the channel generally lies on the main longitudinal axis. It is understood that the embodiments and advantages described here of the corresponding acute angles apply equivalently for the corresponding embodiments with obtuse angles.

In terms of the present invention, the term "elongated contour" means that in the cross section along the above-mentioned cross-sectional plane, the channel extends farther in one direction in this cross-sectional plane than in a different direction. In other words, a channel with an "elongated contour" can be described as being slot-shaped. The person skilled in the art understands a slot-shaped channel to be a channel, which has an elongated narrow contour in the cross section along the cross-sectional plane in the longitudinal direction of the midsole and perpendicularly to the transverse direction of the midsole, and thus provides an elongated narrow opening in the midsole. The expansion of such a channel along a spatial direction is thus greater than along a spatial direction, which differs therefrom, within the same spatial plane. A channel generally in each case has channel walls located opposite one another, which define the opening of the channel. In the case of a channel with an elongated contour, the direct distance of the channel walls in the cross section along the above-mentioned cross-sectional plane is greater in a first direction than in a different spatial direction within the same spatial plane, in particular than in a direction arranged perpendicularly to the first direction.

The main longitudinal axis of a channel in each case extends parallel to the longitudinal direction, i.e., the direction in which the channel extends, and extends through the center point of the channel in the cross section along the above-mentioned cross-sectional plane. The main longitudinal axis lies in the V,L plane of the midsole, i.e. it does not extend in the transverse direction of the midsole but in the longitudinal direction and/or in the vertical direction of the midsole. The main longitudinal axis can typically extend through the points of the channel walls, which are farthest away from one another in the cross section along the above-mentioned cross-sectional plane. The channel walls of a channel can thus have a greater distance from one another along the main longitudinal axis of the channel than along any further axis in the V,L plane of the corresponding channel.

The main longitudinal axis of a channel typically intersects the base surface or a tangent abutting against the point of the intersection of the main longitudinal axis and the base surface, respectively, at an acute angle.

The channels, in particular all channels, of the midsole, furthermore extend in the cross section along the longitudinal direction and perpendicularly to the transverse direction of the midsole, from their respective end arranged closest to the heel edge in the longitudinal direction towards their respective end arranged closest to the sole tip so as to increase in the vertical direction or parallel to the longitudinal direction. In other words, none of the channels of the midsole in the cross section along the longitudinal direction and perpendicularly to the transverse direction of the midsole extends so as to decrease in the vertical direction from its respective end arranged closest to the heel edge in the longitudinal direction towards its respective end arranged closest to the sole tip. The main longitudinal axis of the respective channels, in particular of all of the channels of the midsole, thus increases in the vertical direction or is parallel to the longitudinal direction from the heel edge towards the sole tip. The main longitudinal axis of the respective channels, however, does not decrease in the vertical direction from the heel edge towards the sole tip.

Directional indications, as used in the present disclosure, are to be understood as follows: The longitudinal direction L of the sole is described by an axis from the heel area to the forefoot area and thus extends along the longitudinal axis of the sole. The transverse direction Q of the sole extends transverse to the longitudinal axis and essentially parallel to the underside of the sole or essentially parallel to the ground, respectively. The transverse direction thus extends along a transverse axis of the midsole. In connection with the present invention, the vertical direction or vertical direction V identifies a direction from the underside of the sole in the direction of the insole or, in the operative state, in the direction of the foot of the wearer, respectively, and thus extends along a vertical axis of the sole or of the midsole, respectively. The lateral side of the sole is the external outer boundary of the sole, which, in the worn state, abuts against the outside of the foot of the wearer. The medial side of the sole or of the midsole, respectively, refers to the external inner boundary of the sole, which is arranged opposite to the lateral side. In the case of a pair of running shoes, the medial sides of the two running shoes thus face one another and the lateral sides face away from one another in the worn state. The forefoot area extends, for example, in the longitudinal direction from the sole tip opposite to the longitudinal direction up to 30-45% of the total length of the midsole. The heel area extends, for example, in the longitudinal direction from the heel edge in the longitudinal direction up to 20-30% of the total length of the midsole. The midfoot area thereby extends directly between the heel area and the forefoot area, so that the length in the longitudinal direction of the midfoot area accounts for the remaining portion of the total length, in particular of 15-50% of the total length.

The person skilled in the art understands that if the base surface is curved in the longitudinal direction of the midsole and perpendicularly to the transverse direction of the midsole in the cross section along a cross-sectional plane, in particular convexly to the ground when running, the acute angle between the main longitudinal axis and the base surface refers to the angle between the main longitudinal axis and the respective tangent at the base surface at the point of intersection of the main longitudinal axis and the base surface. It is important to note that the acute angle of a channel, in the case of which the main longitudinal axis of the channel does not have a point of intersection with the base surface, can be defined at the point of intersection of the main longitudinal axis with the lengthening tangent at the point of contact of the base surface and the heel edge at the base surface.

Elastic, in particular soft elastic materials for soles are well known to the person skilled in the art. For example, materials with a Young's modulus of approximately 0.0001 to 0.2 GPa, in particular 0.001 to 0.1 GPa can be used, which, in terms of the present invention, can be considered to be elastic or soft elastic material, respectively. Such materials can typically comprise polymer foams. Polyurethane, in particular thermoplastic polyolefins, polyolefin block polymers, polyvinyl acetates, in particular EVA, polyurethane (TPU) or expanded thermoplastic polyurethane (eTPU), polyamides, e.g. PA-11, PA-12, nylon, polyether block amide (PEBAX®), polyethylene terephthalate (PET) or polybutylene terephthalate (PBT) or mixtures thereof can be used as elastic or as soft elastic materials, respectively.

With the exception of possible lateral-side and/or medial-side openings, the channels in the lateral area of the midsole are preferably delimited completely by the soft elastic midsole. In the cross section along a cross-sectional plane in the longitudinal direction (L) of the midsole and perpendicularly to the transverse direction (Q) of the midsole, the channels are in particular delimited completely by the midsole. In such an embodiment, the channel walls can thus be formed completely by the midsole in the lateral area of the midsole. In the side view of the sole, the channels can thus typically be described as transverse openings in an otherwise preferably one-piece midsole. In preferred embodiments, the midsole does not have a segmentation, is thus free from segmentation. The durability of the sole can be improved significantly thereby because, compared to a segmented midsole, the midsole is generally formed to be significantly more stable. A fatigue of the soft elastic midsole is furthermore avoided over the useful life of the sole or of the running shoe, respectively, or is at least significantly reduced. The advantageous cushioning effect of the midsole can thereby constantly be maintained over a long period of time.

In terms of the present invention, a channel is to be understood to be a recess, which can typically be formed in a tube-shaped manner. Except for at the lateral openings, a channel is generally delimited completely or partially by its channel walls. The channels are typically empty. The channels can in particular be open and continuous, i.e., a channel is preferably not a blind hole. A channel, in particular all of the channels of the midsole, preferably extend continuously from the lateral side of the midsole to the medial side of the midsole. In preferred embodiments, the channels can extend essentially parallel to one another. In some embodiments, the total portion of the open area of the midsole, i.e., the total portion of the lateral surfaces of the channel openings, can be smaller than the total portion of the closed surface of the midsole, i.e., the total portion of the outer surface of the midsole, which does not have any channels. In some embodiments, the channels are arranged one behind the other only in the longitudinal direction, thus from the heel edge towards the sole tip. This does not rule out that some or also all channels can be arranged offset from one another in the vertical direction. In the vertical direction, no channels are preferably arranged completely and/or partially one on top of the other.

In some embodiments, the channels are arranged one behind the other in the longitudinal direction from the heel edge to the sole tip of the sole, and at least two or more channels are arranged offset from one another in the vertical direction. In certain embodiments, the channels are arranged in at least a first and a second horizontal plane in the lateral and/or medial area of the midsole. The first and second horizontal plane are thereby formed to be offset vertically from one another. By means of the arrangement of the channels in at least a first and a second horizontal plane, a significant improvement of the cushioning effect is attained. The cushioning is thereby additionally no longer limited to individual segments of the sole but extends essentially over the entire midsole.

A horizontal plane of the sole describes a plane, which is aligned essentially parallel to the underside of the sole or essentially parallel to the ground, respectively. It is also understood that the horizontal plane can also be slightly curved. This can be the case, for example, when the sole is slightly curved vertically upwards at the forefoot area and/or at the heel area, as is typical for running shoes.

It is clear to the person skilled in the art that the deformability of the channels can comprise, for example, vertically bringing together the channel walls and/or shearing of the channel in the longitudinal direction. The upper and the lower channel wall can typically touch one another under the effect of the forces occurring when running, so that the corresponding channel is deformed until lateral closure.

In a preferred embodiment, the elastic midsole is formed in one piece. The elastic midsole thus preferably consists of a single material and is thus more stable than a midsole consisting of several components, in particular components which are glued or welded to one another.

In a preferred embodiment, the channels have lateral openings in the lateral area of the midsole. The channels can preferably be deformed vertically and/or horizontally in the longitudinal direction under the effect of forces, which act vertically and/or in the longitudinal direction and which occur when running. The upper and the lower channel wall can typically touch one another under the effect of the forces occurring when running.

In some embodiments, the acute angle between the main longitudinal axis and the base surface becomes smaller from a channel in the heel area, in particular the channel arranged closest to the heel edge of the midsole, to a channel in the midfoot area and/or to a channel in the forefoot area, in particular to the channel arranged closest to the sole tip, the acute angle can in particular become continuously smaller from the channel arranged closest to the heel edge of the midsole to the channel arranged closest to the sole tip at least over a subarea in the longitudinal direction of the sole or over the entire length of the sole in the longitudinal direction. For example, the acute angle between main longitudinal axis and base surface becomes continuously smaller thereby from channel to channel from the heel edge into the midfoot area. In the forefoot area, the acute angle can thereby be 0° throughout. The main longitudinal axis of the channels in the forefoot area can in particular be parallel to the base surface. Viewed from channel to channel, the channels thereby decrease from the heel edge in the direction of the sole tip. It is attained thereby that an increased cushioning effect can be attained in the heel area, while a lower cushioning effect is attained due to the smaller acute angles between the base surface and the main longitudinal axis in the forefoot area and/or in the midfoot area, which has the result that hardly any energy gets lost due to the cushioning when pushing off. It generally applies that the greater the acute angle between the main longitudinal axis of a channel and the base surface, the greater the cushioning effect. It is thus advantageous that the channel arranged closest to the heel edge has the greatest acute angle because the required cushioning effect is greatest here. The farther a channel is arranged towards the sole tip in the longitudinal direction, the smaller the required cushioning effect, so that the acute angle between the main longitudinal axis and the base surface is selected to be smaller.

Alternatively, the above embodiment can be described in such a way that the obtuse angle between the main longitudinal axis and the perpendicular channel line of the respective channel becomes smaller from a channel in the heel area, in particular the channel arranged closest to the heel edge of the midsole, to a channel in the midfoot area and/or to a channel in the forefoot area, in particular to the channel arranged closest to the sole tip. The obtuse angle can in particular become continuously smaller from the channel arranged closest to the heel edge of the midsole to the channel arranged closest to the sole tip at least over a subarea in the longitudinal direction of the sole or over the entire length of the sole in the longitudinal direction.

In some embodiments, the acute angle between the main longitudinal axis and the base surface of each channel first becomes greater from the channel arranged closest to the heel edge of the midsole from channel to channel in the longitudinal direction towards the sole tip, and subsequently becomes smaller from channel to channel in the longitudinal direction towards the sole tip. In such embodiments, the acute angle between the main longitudinal axis and the base surface of each channel can become continuously greater from the channel arranged closest to the heel edge of the midsole from channel to channel all the way to a steep channel arranged father in the longitudinal direction to the sole tip, wherein the steep channel thereby represents the channel of the midsole with the greatest acute angle between the main longitudinal axis and the base surface of the channel, and can subsequently become smaller from there in the longitudinal direction to the sole tip from channel to channel. In such embodiments, the midsole thus has channels in the heel area, wherein the channel arranged closest to the heel edge has the smallest acute angle between the main longitudinal axis and the base surface of the channel of all channels in the heel area. The corresponding acute angle then increases, for example, over the two channels following in the longitudinal direction to the sole tip, in particular continuously. The midfoot area can then connect directly to these channels, wherein the acute angle between the main longitudinal axis and the base surface of the channel arranged closest to the heel edge is smaller in the midfoot area than the corresponding acute angle of at least one, at least two, or of all channels in the heel area.

Alternatively, the above embodiment can be described in such a way that the obtuse angle between the main longitudinal axis and the perpendicular channel line of each channel first becomes greater from the channel arranged closest towards the heel edge of the midsole from channel to channel in the longitudinal direction towards the sole tip, and subsequently becomes smaller from channel to channel in the longitudinal direction to the sole tip.

It has been shown by means of corresponding analyses that such embodiments are particularly advantageous because all channels virtually close completely in the heel area when treading, which, on the one hand, means that forces acting vertically as well as horizontally are absorbed efficiently and, on the other hand, secure stand is made possible when treading, without resulting in a floating effect. It is also shown that the horizontally acting forces are not necessarily greatest at the heel edge, i.e., at the channel arranged closest to the heel edge, but generally in a subarea of the heel area arranged closer to the sole tip farther in the longitudinal direction. Due to the fact that the acute angle between the main longitudinal axis and the base surface of each channel or the obtuse angle between the main longitudinal axis and the perpendicular channel line of the channel, respectively, first becomes greater from the channel arranged closest to the heel edge of the midsole from channel to channel in the longitudinal direction towards the sole tip, and subsequently becomes smaller from channel to channel in the longitudinal direction towards the sole tip, a maximum absorption of the horizontally acting forces is thus achieved.

The channel of the midsole, which, of all channels of the midsole has the greatest acute angle between its main longitudinal axis and the base surface, or the greatest obtuse angle between its main longitudinal axis and its perpendicular channel line, respectively, is thus preferably arranged in the heel area and is referred to as steep channel.

The steep channel is typically arranged, starting at the heel edge, in the longitudinal direction towards the sole tip at 15% to 30%, preferably 20% to 30%, in particular 25% to 30%, of the total length of the sole or of the midsole, respectively.

In some embodiments, the steep channel, i.e., the channel of the midsole, which, of all channels of the midsole has the greatest acute angle between its main longitudinal axis and the base surface or the greatest obtuse angle between its main longitudinal axis and its perpendicular channel line, respectively, can be the third channel of the midsole starting at the heel edge in the longitudinal direction.

The acute angle between the main longitudinal axis and the base surface of the steep channel is thereby preferably between 35° and 85°, in particular between 40° and 75°. The obtuse angle between the main longitudinal axis and the perpendicular channel line of the steep channel can be between 125° and 170°, in particular between 125° and 165°, preferably between 155° and 165°. Due to the relatively large angle of the steep channel, not only a good vertical cushioning is attained in this area of the midsole, but also a large horizontal cushioning.

In some embodiments, the acute angle between the main longitudinal axis and the base surface of at least one channel arranged in the forefoot area, in particular of all of the channels arranged in the forefoot area, is between 0° to 15°, in particular 0° to 5°, in particular 0° to 2°. An angle of 0° means that the main longitudinal axis of the channel and the base surface are arranged essentially parallel to one another. In the case of a curved base surface, this parallelism refers to a tangent abutting against the base surface, which abuts against the base surface below the channel in the vertical direction. Small angles of this type have the effect that even though a sufficient cushioning is still provided on the one hand, so that the joints of the wearer are protected sufficiently, the cushioning is not too large, on the other hand, that a significant portion of the push-off energy gets lost due to the cushioning.

In some embodiments, the obtuse angle between the main longitudinal axis and the respective perpendicular channel line of at least one channel arranged in the forefoot area, in particular of all of the channels arranged in the forefoot area, is between 90° to 100°, in particular 90° to 95°. An angle of 90° means that the main longitudinal axis of the channel and the base surface are arranged essentially parallel to one another. In the case of a curved base surface, this parallelism refers to a tangent abutting against the base surface, which abuts against the base surface below the channel in the vertical direction.

In some preferred embodiments, the main longitudinal axis of at least one channel arranged in the forefoot area, in particular of all of the channels arranged in the forefoot area, is arranged essentially parallel to the base surface.

In some embodiments, each channel has a main lateral axis. The main lateral axis is thereby typically perpendicular to the respective main longitudinal axis of the channel. The height, i.e., the direct distances of the channel walls of a channel along the main lateral axis of a channel arranged in the forefoot area is thereby smaller than the width along the main lateral axis of a channel arranged in the midfoot area and/or in the heel area. A high cushioning effect is attained in the heel area thereby. At the same time, the cushioning effect in the forefoot area is significantly smaller, whereby less energy gets lost when pushing off.

In some embodiments, the acute angle between the main longitudinal axis and the base surface of a channel arranged in the heel area, in particular of all of the channels arranged in the heel area, is between 5° and 85°, in particular between 35° and 85°, preferably between 40° and 75°. Due to the relatively large angle, not only a good vertical cushioning is attained, but also a large horizontal cushioning because the channels can be closed by means of the forces acting horizontally when running, in particular by contacting the channel walls of a channel.

In some embodiments, the obtuse angle between the main longitudinal axis and the respective perpendicular channel line of a channel arranged in the heel area, in particular of all of the channels arranged in the heel area, is between 110° and 175°, in particular between 125° and 170°, preferably between 125° and 165°. Due to the relatively large angle, not only a good vertical cushioning is attained, but also a large horizontal cushioning because the channels can be closed by means of the forces acting horizontally when running, in particular by contacting the channel walls of a channel.

In certain embodiments, the acute angle between the main longitudinal axis and the base surface or the obtuse angle between the main longitudinal axis and the respective perpendicular channel line, respectively, becomes continuously smaller from the channel arranged closest to the heel edge of the midsole in the direction of the sole tip in the heel area or also exclusively in the heel area.

In some embodiments, the acute angle between the main longitudinal axis and the base surface of a channel arranged in the midfoot area is between 0° and 35°, preferably between 0° and 25°. The midfoot area represents an intermediate area, where a certain cushioning effect is still required when treading on the one hand, but the cushioning effect must not be too great on the other hand because in particular the front part of the midfoot area, viewed in the longitudinal direction towards the sole tip, is already used for pushing off the ground. The acute angle between the main longitudinal axis and the base surface of a channel, which connects directly to a channel in the heel area, is particularly preferably greater than 0°, for example between 10° and 35° or 10° to 25°. In certain embodiments, the acute angle between the main longitudinal axis and the base surface becomes continuously smaller from the channel arranged in the midfoot area of the heel edge of the midsole in the direction of the sole tip in the heel area.

In some embodiments, the obtuse angle between the main longitudinal axis and the respective perpendicular channel line of a channel arranged in the midfoot area is between 90° and 120°, preferably between 90° and 115°.

In further embodiments, the channels each have lateral openings on the lateral side and/or the medial side of the midsole. These openings can close by means of the forces occurring when running, in particular close completely, in that the channel walls of a channel touch. The channels arranged in the heel area and/or in the midfoot area and/or in the forefoot area can thus be designed to completely close the lateral openings by means of the forces occurring when running. The forces occurring when running are typically attributed to the weight force based on the weight of the wearer, which can be, for example, between 40 and 120 kg, in particular between 50 and 100 kg.

In some embodiments, the channels are configured such that the channels assume an S-shape upon complete closure, in particular in response to the complete closure of the lateral openings.

In some embodiments, the channels have a rectangular, oval, pentagonal, hexagonal and/or drop-shaped, in particular lancet-shaped contour, in each case in the cross section along the cross-sectional plane in the longitudinal direction of the midsole and perpendicularly to the transverse direction of the midsole. It is also possible thereby that one or several channels of the midsole have a different contour than other channels of the midsole. The midsole can in particular have up to 5 channels with different contour. A drop-shaped contour refers to a shape, which is essentially characterized of an isosceles triangle and a circular segment connected thereto. The person skilled in the art understands that these contours also include shapes with rounded corners, i.e., e.g., a rectangle with rounded corners. A drop-shaped, in particular lancet-shaped contour is particularly preferred thereby, in particular when the portion of the circular segment of the drop shape is aligned towards the base surface. This is so because a particularly large horizontal cushioning of forces acting in the horizontal direction when running can be achieved thereby. A drop-shaped, in particular a lancet-shaped contour furthermore allows for a particularly controlled closure of the channels, so that a floating effect is avoided. The reason for this is that in particular channels with a drop-shaped contour are designed to assume an S-shape in response to closure. It is understood that channels with a drop-shaped contour are arranged in particular in the heel area. In contrast, channels with a different contour, in particular a rectangular, pentagonal and/or hexagonal contour can thereby be provided in the forefoot area and/or in the midfoot area.

In some embodiments, the channels each have a width of 0.3 cm to 3 cm, preferably of 0.5 cm to 2 cm, along the main longitudinal axis. The width describes the distance of the channel walls of a channel along the main longitudinal axis and thus in some embodiments the greatest expansion in the cross-sectional plane along the longitudinal direction and transversely to the transverse direction of the sole.

In some embodiments, the channels each have a height of 0.3 cm to 1.5 cm, preferably of 0.3 cm to 1 cm, along the main lateral axis.

In some embodiments, the steep channel along the main longitudinal axis has a width, which is greater than the width along the respective main longitudinal axis of any other channel of the midsole.

In some embodiments, the steep channel along the main lateral axis has a height, which is greater than the height along the respective main lateral axis of any other channel of the midsole.

In some embodiments, the vertical distance of at least one, in particular of a single, channel in the heel area between the respective channel and the top surface of the midsole is smaller than in the case of a different channel in the heel area and/or than in the case of a different channel of the midsole. It has been shown that a smaller vertical distance in the case of a channel in the heel area leads to an improved cushioning effect than when the vertical distance is greater. The closer the channel is arranged to the top surface, i.e., the smaller the corresponding vertical distance, the better the cushioning effect. An ideal compromise between a good cushioning and a sole, which still provides for a strong push-off with the lowest possible loss of force, is found by means of such embodiments.

The vertical distance between a channel and the top surface of the midsole refers to the shortest distance along the vertical direction of the sole between a channel or its channel wall, respectively, and the top surface of the midsole. This vertical distance thus typically corresponds to the smallest thickness of the midsole in the vertical direction between the respective channel and the top surface of the midsole.

In the case of a channel, for which the vertical distance of the corresponding channel is smaller than for a different channel, the vertical distance of the channel from the base surface of the midsole is, vice versa, greater than for the other channel. The corresponding channel with the smaller vertical distance from the top surface of the midsole to the other channel or to the other channels, respectively, is thus arranged offset in the vertical direction. Vice versa, the other channels can be described as being offset opposite to the vertical direction to the channel with the smaller vertical distance from the top surface of the midsole.

In some embodiments, for the channels in the heel area and optionally in the midfoot area, in particular exclusively for the channels in the heel area the vertical distance between the respective channel and the top surface of the midsole of each channel becomes smaller from the channel arranged closest to the heel edge of the midsole from channel to channel in the longitudinal direction towards the sole tip. It has been shown that the horizontally acting forces are not mandatorily greatest on the heel edge, i.e., on the channel arranged closest to the heel edge, but in a subarea of the heel area, which is arranged further in the longitudinal direction and closer to the sole tip. Due to the decreasing vertical distance, the greatest cushioning can thus be arranged in the area, which is accordingly loaded the most, which protects the wearer on the one hand, but which does not represent a sole, which is perceived to be too soft, i.e., spongy, on the other hand.

In some embodiments, the vertical distance of the respective channel to the top surface of the midsole first becomes smaller from the channel arranged closest to the heel edge of the midsole from channel to channel in the longitudinal direction towards the sole tip, and subsequently becomes greater from channel to channel in the longitudinal direction towards the sole tip. In other words, the channels in such embodiments are arranged in such a way that the vertical distances of the respective channels, viewed onto the lateral side or the medial side of the sole from the heel area in the longitudinal direction towards the sole tip in the heel area first become smaller, then reaches a minimum, and then become greater again.

In some embodiments, the vertical distance between the channel in the heel area, which is arranged closest to the sole tip in the longitudinal direction, in particular the third channel starting at the heel edge along the longitudinal direction in the direction of the sole tip, and top surface of the midsole can be smaller than the vertical distance between any other channel of the midsole and top surface of the midsole.

In preferred embodiments, the vertical distance of the steep channel to top surface of the midsole can be smaller than the distance of any other channel to top surface of the midsole.

In some embodiments, a portion of the channels, in particular all channels, of the midsole can in each case taper in the transverse direction from the lateral side towards the medial side of the midsole. The open surface of such a channel thus becomes smaller in the cross section along a cross-sectional plane along the longitudinal direction and perpendicularly to the transverse direction of the midsole from the lateral side in the transverse direction towards the medial side of the midsole. This has the advantage that the stability of the sole, in particular when treading, is increased, without the cushioning properties being decreased significantly. Additionally, or alternatively, a portion of the channels, in particular all channels, of the midsole can in each case taper in the transverse direction from the medial side towards the lateral side of the midsole. These two alternatives thereby support different running styles of the wearer, depending on whether the sole is loaded increasingly on the lateral side or on the medial side. It is also possible that, for example, the channels in the forefoot area in each case taper in the transverse direction from the lateral side towards the medial side of the midsole and that the channels in the heel area in each case taper in the transverse direction from the medial side towards the lateral side of the midsole, and vice versa. In addition, the channels in the midfoot area can in each case taper in the transverse direction from the lateral side towards the medial side of the midsole or can in each case taper in the transverse direction from the medial side towards the lateral side of the midsole.

A further aspect of the invention relates to a shoe, in particular a running shoe, comprising a sole according to one of the embodiments described here.

A further aspect of the invention relates to the use of a sole according to one of the embodiments described here for producing a shoe, in particular a running shoe.

BRIEF DESCRIPTION OF SEVERAL VIEWS OF THE DRAWINGS

Aspects of the invention will be described in more detail on the basis of the exemplary embodiments shown in the following figures and the corresponding description.

DETAILED DESCRIPTION OF THE INVENTION

Figure 1A:
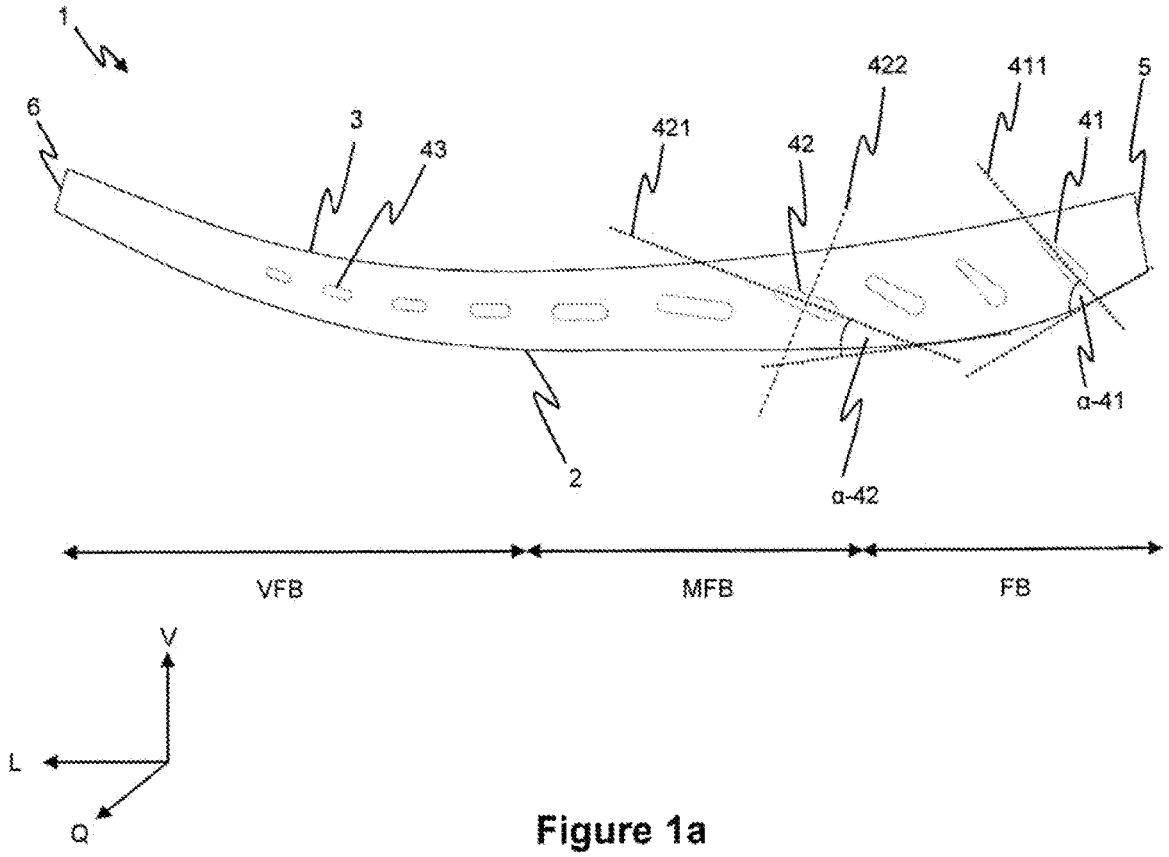
FIG. 1*a* shows a schematic side view of a sole according to the invention for a running shoe according to an embodiment of the invention.
Figure 1B:
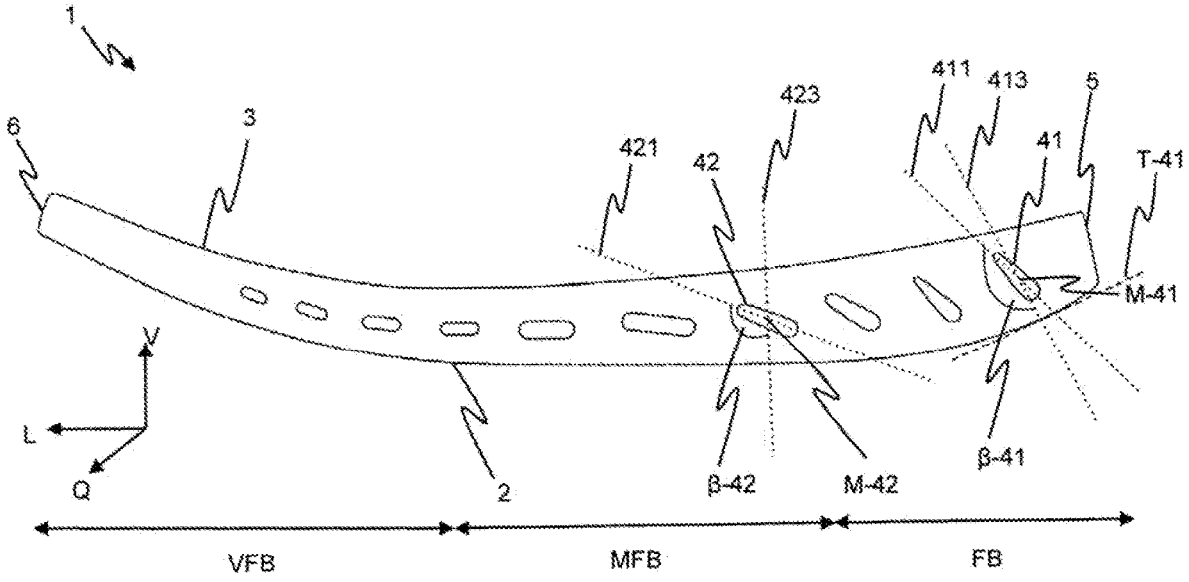
FIG. 1*b* shows a schematic side view of a sole according to the invention for a running show according to an embodiment of the invention.

A sole according to the invention for a running shoe is shown in FIGS. 1*a* and 1*b*, which has an elastic midsole 1. The midsole 1 is delimited opposite to the vertical direction V by the base surface 2 and in the vertical direction V by top surface 3. The midsole 1 is additionally divided into a heel area FB, a midfoot area MFB, and a forefoot area VFB. As illustrated, these three areas are arranged one behind the other in the longitudinal direction, whereby the midfoot area MFB is arranged between the heel area FB and the forefoot area VFB. The midsole 1 comprises several channels 41, 42, 43 (for the sake of clarity, only three of the channels are identified), which extend in the transverse direction Q of the midsole 1 and which are arranged one behind the other in the longitudinal direction L of the midsole 1. In the transverse direction Q, these channels can generally be arranged essentially parallel to one another. The channels 41, 42, 43 thereby each have an elongated contour in the cross section along a cross-sectional plane in the longitudinal direction L of the midsole 1 and perpendicularly to the transverse direction Q of the midsole. In the shown coordinate system, this cross-sectional plane is the V,L plane, each channel 41, 42, 43 in the cross section along the cross-sectional plane in the longitudinal direction L and perpendicularly to the transverse direction Q has a main longitudinal axis 411, 421 (for the sake of clarity, only main longitudinal axes of two of the channels are illustrated). It can be seen thereby that the acute angle α-41 between the main longitudinal axis 411 and the base surface 2 or the tangent at the point of intersection of the main longitudinal axis 411 and the base surface 2, respectively, of the channel 41 arranged in the heel area FB is greater than the acute angle α-42 between the base surface 2 (or the tangent at the point of intersection of the main longitudinal axis 411 and the base surface 2, respectively) and the main longitudinal axis 421 of at least the channel 42 arranged in the midfoot area MFB. The angle between main longitudinal axis and base surface thereby becomes continuously smaller from channel to channel from the heel edge 5 towards the sole tip 6 all the way into the midfoot area and is essentially 0° in the forefoot area, i.e., the main longitudinal axis of the channels in the forefoot area VFB is parallel to the base surface 2. The channels additionally each have a main lateral axis 422 (for the sake of clarity, only the main lateral axis 422 of the channel 42 is illustrated), which is perpendicular to the main longitudinal axis. The height of a channel is defined as the distance of the channel walls of a channel along the main lateral axis. As shown in FIG. 1, the height along the main lateral axis of the channel 43 arranged forefoot area VFB is smaller than the height along the main lateral axis of a channel 41, 42 arranged in the midfoot area MFB and/or in the heel area FB. The channels in the forefoot area VFB thereby have a rectangular contour in the cross section along the cross-sectional plane in the longitudinal direction L of the midsole 1 and perpendicularly to the transverse direction Q of the midsole 1. Due to the fact that the edge lengths of two edges of the rectangle, which are parallel to one another, in one direction is longer than the edge lengths of the two other edges, which extend parallel to one another, the corresponding channels have an elongated contour.

The embodiment of FIG. 1*a* is shown in FIG. 1*b*, instead of the acute angles α-41 and α-42 between the main longitudinal axis 411 and 421 and the base surface 2 or the tangent at the point of intersection of the main longitudinal axis 411 and 421 and the base surface 2, respectively, however, the obtuse angle β-41 between the main longitudinal axis 411 and the perpendicular channel line 413 of the channel 41 is illustrated. The perpendicular channel line thereby extends through the center point M-41 of the channel 41, which lies on the main longitudinal axis 411 and from which in particular the front and rear end of the channel 41 are spaced apart evenly. The perpendicular channel line is additionally perpendicular to the base surface 2 or to the tangent (see tangent T-41), which abuts against the base surface 2 in the point of the intersection of the perpendicular channel line (see perpendicular channel line 413) with the base surface 2, respectively. The obtuse angle β-42 between the main longitudinal axis 421 of the channel 42 and the perpendicular channel line 423 of the channel 42 is shown in the same way. The obtuse angle β-41 of the channel 41, which is arranged in the heel area FB, is thereby greater than the obtuse angle β-42, which is arranged in the midfoot area MFB.

Figure 2:
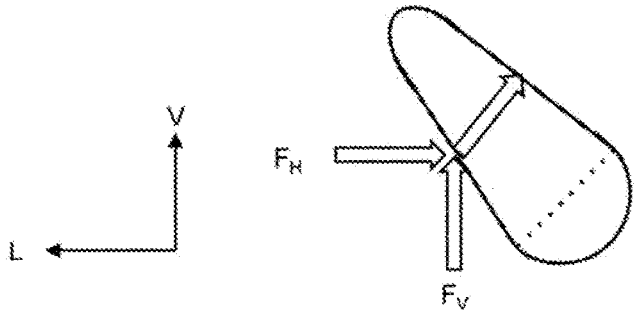
FIG. 2 shows a schematic illustration of a channel comprising a channel, which is drop-shaped in the V,L plane, as it is provided in some embodiments of the sole according to the invention.

A channel with a contour, which is drop-shaped in the cross section along the V,L plane, thus along the cross-sectional plane in the longitudinal direction L of the midsole and perpendicularly to the transverse direction Q of the midsole, is shown in FIG. 2. The drop-shaped contour essentially consists of an isosceles triangle, in this case with rounded tip, and a spherical segment, in this case a hemisphere, as is suggested by means of the dotted line. A drop-shaped contour can thereby also be described, for example, as lancet-like contour. Such a drop-shaped contour has turned out to be particularly advantageous for the heel area because a horizontal force FH, i.e., acting opposite to the longitudinal direction L, as well as a vertical force FV, i.e., acting in the vertical direction V, can be damped efficiently because this leads to a partial or complete closure of the lateral openings, in that the channel walls of the respective channel move towards one another. A cushioning of horizontally acting forces can be effected thereby completely without segmentation of the midsole and even in the case of channels, which are formed completely by the midsole in the V,L plane.

Figure 3A:
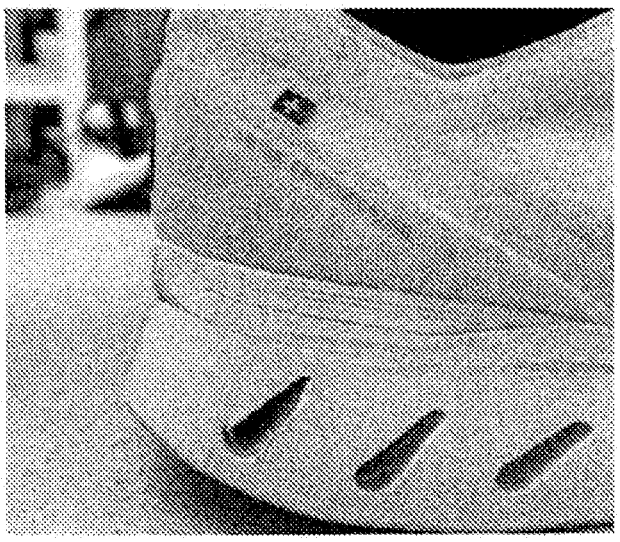
FIG. 3*a* shows a photograph of a heel area of a shoe comprising a sole according to the invention in the unstrained state.
Figure 3B:
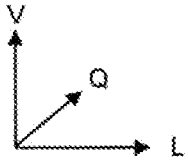
FIG. 3*b* shows a photograph of a heel area of a shoe comprising a sole according to the invention in the strained state.
Figure 3B:
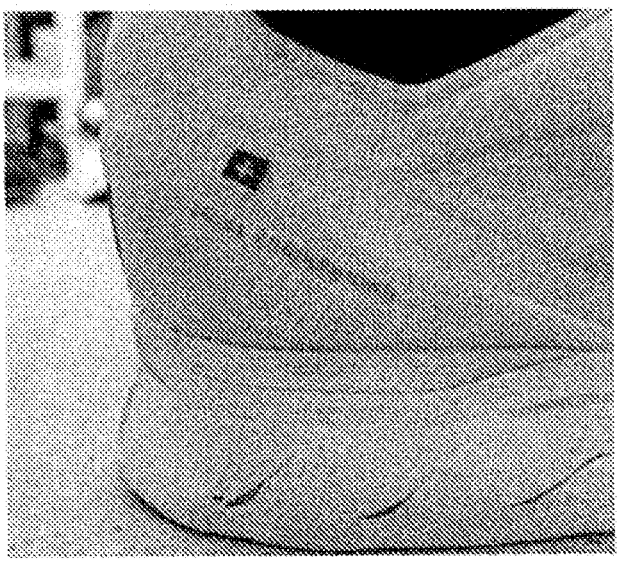

A running shoe comprising a midsole according to the invention in the unstrained state is illustrated in FIG. 3*a*. If the vertical and horizontal forces, which occur when running, now act on the midsole, this leads to a closure of the channels, which is essentially S-shaped, in particular directed in the longitudinal direction L. Forces occurring horizontally as well as vertically when running can be cushioned efficiently thereby.

Figure 4:
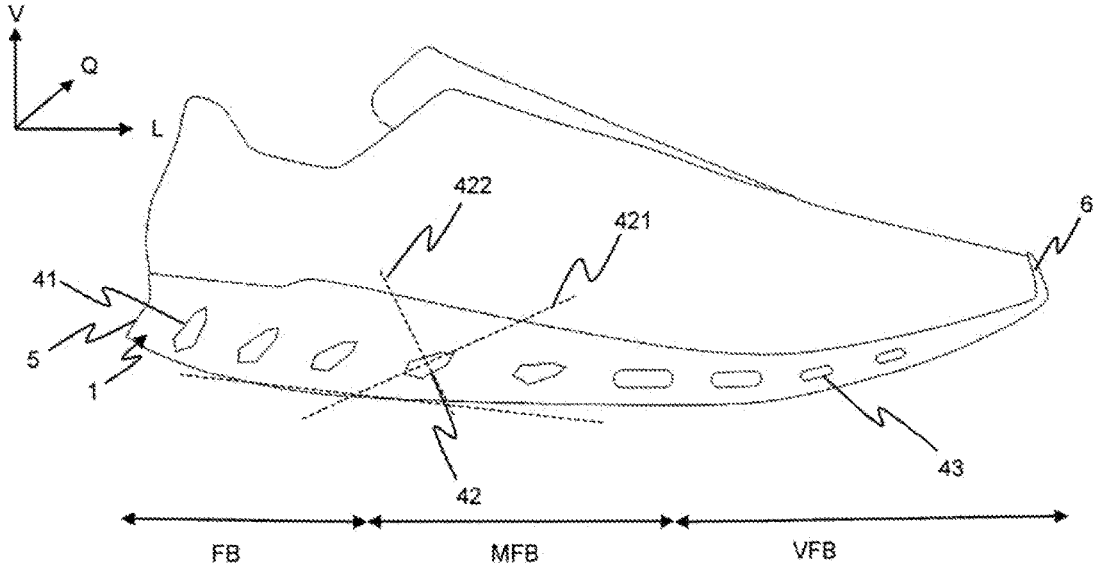
FIG. 4 schematically shows a side view of a running shoe comprising a sole according to a further embodiment of the invention

A running shoe comprising a midsole 1 according to the invention according to a further embodiment of the invention is shown in FIG. 4. In contrast to the midsole of FIG. 1, the midsole 1 shown in FIG. 4 has channels 41 and 42 (for the sake of clarity, only a total of three channels are identified), which have a hexagonal contour in the cross section along the V,L plane, thus along the cross-sectional plane in the longitudinal direction L of the midsole and perpendicularly to the transverse direction Q of the midsole, in the heel area FB and partially also in the midfoot area MFB. As it is shown, this contour has to thereby not represent a regular hexagon. The main longitudinal axis 421 of the channel 42 extends through the center point of the channel 42 in the V,L plane and extends parallel to the longitudinal direction, i.e., the direction in which the channel extends. The main longitudinal axis additionally extends through the points of the channel walls, which are farthest away from one another in the cross section along the above-mentioned cross-sectional plane. The channels in the forefoot area and partially also channels in the midfoot area have a rectangular contour with rounded corners, as it is shown, e.g., for channel 43.

Figure 5:
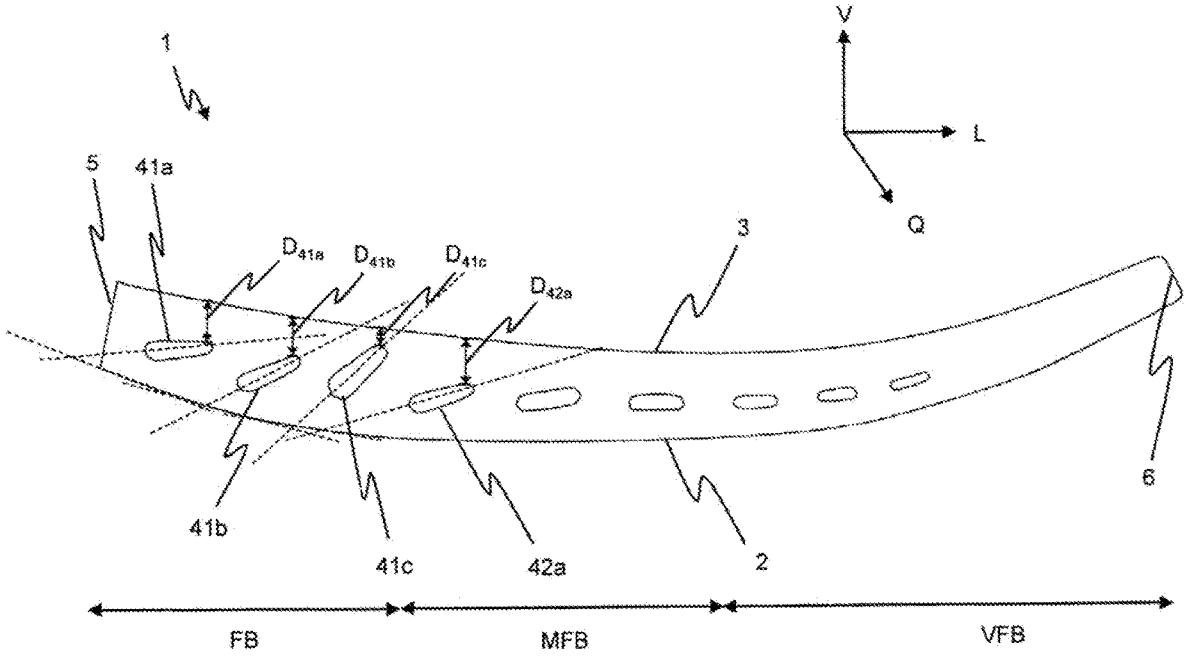
FIG. 5 shows a schematic side view of a sole according to the invention for a running shoe according to a further embodiment of the invention.

A further embodiment of the sole according to the invention comprising midsole 1 is shown in FIG. 5. It is delimited opposite to the vertical direction V by the base surface 2 and in the vertical direction V by top surface 3. The midsole 1 is furthermore divided into a heel area FB, a midfoot area MFB, and a forefoot area VFB. The midsole 1 comprises several channels 41*a*, 41*b*, 41*c*, and 42*a* (for the sake of clarity, only four of the channels are identified), which extend in the transverse direction Q of the midsole 1 and which are arranged one behind the other in the longitudinal direction L of the midsole 1. The channels 41*a*, 41*b*, and 41*c* are thereby arranged in the heel area, while the channel 42*a* is arranged in the midfoot area and thereby represents that channel in the midfoot area, which is arranged closest to the heel edge 5. As in the embodiment shown in FIG. 1, each channel in the cross section along the cross-sectional plane in the longitudinal direction L and perpendicularly to the transverse direction Q has a main longitudinal axis (for the sake of clarify, they are not identified). It can be seen that the acute angle between the main longitudinal axis and the base surface of each channel first becomes greater from the channel 41*a* arranged closest to the heel edge of the midsole from channel to channel 41*b*, 41*c* in the longitudinal direction to the sole tip, and subsequently becomes smaller from channel to channel 42*a* in the longitudinal direction to the sole tip. It is important to note that the acute angle of the channel 41*a* is defined by the main longitudinal axis of the channel 41*a* and the lengthening tangent at the point of contact of the base surface 2 and the heel edge 5. The channel 41*c* is the steep channel of the midsole, i.e., that channel, which, of all channels of the midsole, has the greatest acute angle between its main longitudinal axis and the base surface. In the shown embodiment of the midsole 1, the vertical distance D41*c* of the channel 41*c*, thus of the steep channel, as well as the vertical distance D41*c* of the channel 41*b*, both of which are arranged in the heel area, to top surface 3 of the midsole 1 is furthermore smaller than in the case of the channel 41*a* in the heel area and/or than in the case of a different channel 42*a* of the midsole 1. The vertical distance D41*a*, D41*b*, D41*c* between the respective channel 41*a*, 41*b*, 41*c* and top surface 3 of the midsole becomes continuously smaller from the channel 41*a* arranged closest to the heel edge of the midsole from cannel to channel in the longitudinal direction towards the sole tip in the heel area. The vertical distance reaches a minimum at the steep channel 41*c* and then becomes greater again at the following channel in the longitudinal direction L to the sole tip 6.

Figure 6:
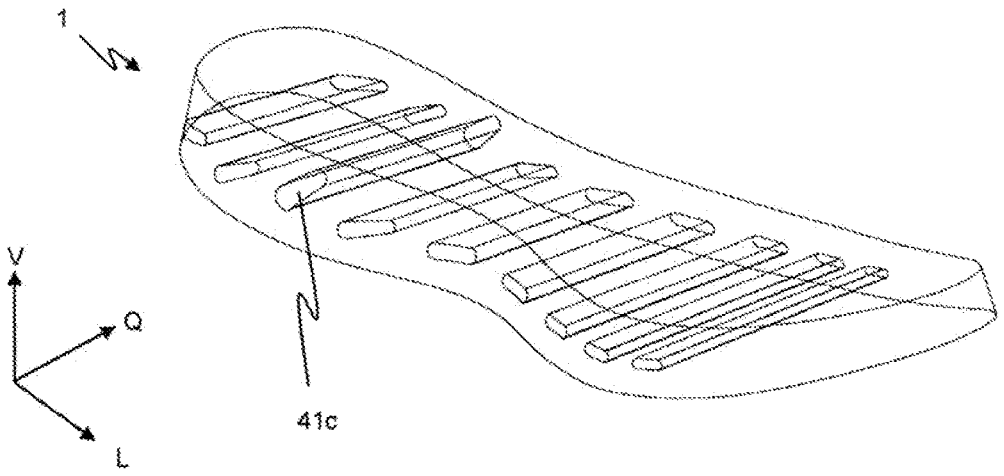
FIG. 6 shows a schematic perspective view of the sole according to FIG. 5 in the case of which the course of the channels in the sole is illustrated.

FIG. 6 shows a perspective view of the embodiment from FIG. 5. It can be seen that the steep channel 41*c* has the greatest acute angle between its main longitudinal axis and the base surface. In the case of the channels in the direction of the heel edge as well as in the case of the channels in the direction of the sole tip, the corresponding acute angle between the respective main longitudinal axis and the base surface is generally smaller than in the case of the steep channel 41.

Figure 7:
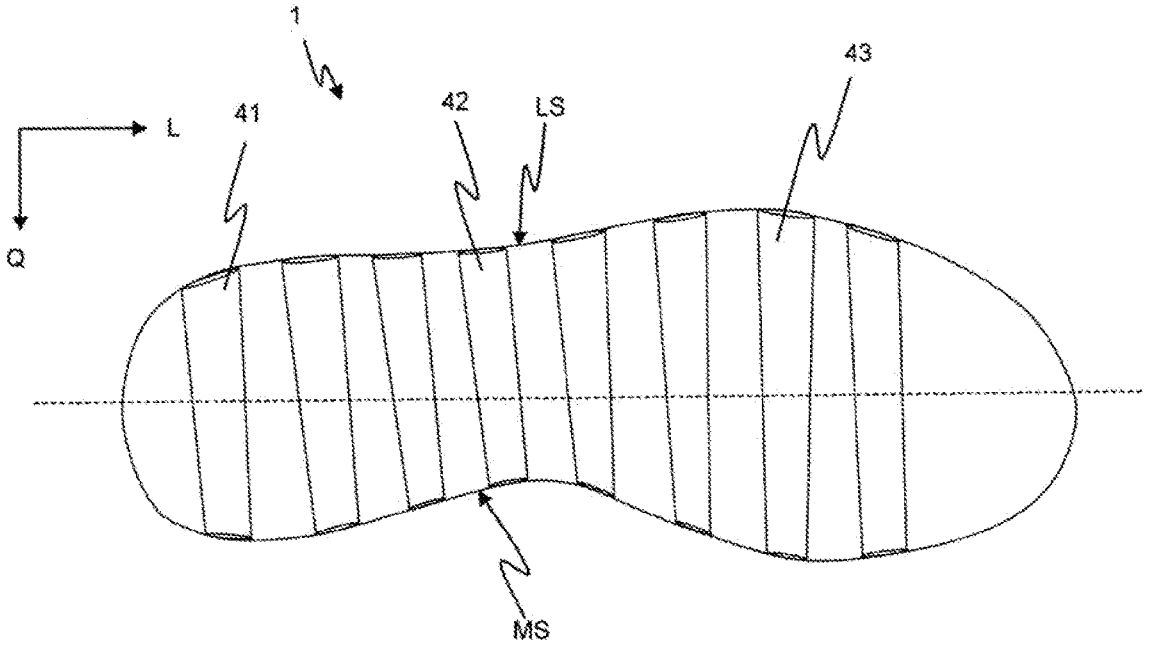
FIG. 7 shows a view from below onto the course of the cut channels in a sole according to a further embodiment of the invention in a sectional illustration, wherein, for illustration purposes, the channels are illustrated as lying in a plane.

FIG. 7 schematically shows a strongly schematized horizontal section of a sole according to a further embodiment of the invention. All of the channels do in fact not mandatorily lie in the same plane. It is to be illustrated that in the case of this embodiment, the channels 41, 42, and 43 (for the sake of clarity, only three of the channels are identified) taper in the transverse direction from the lateral side LS of the midsole to the medial side MS of the midsole.

Figure 8:
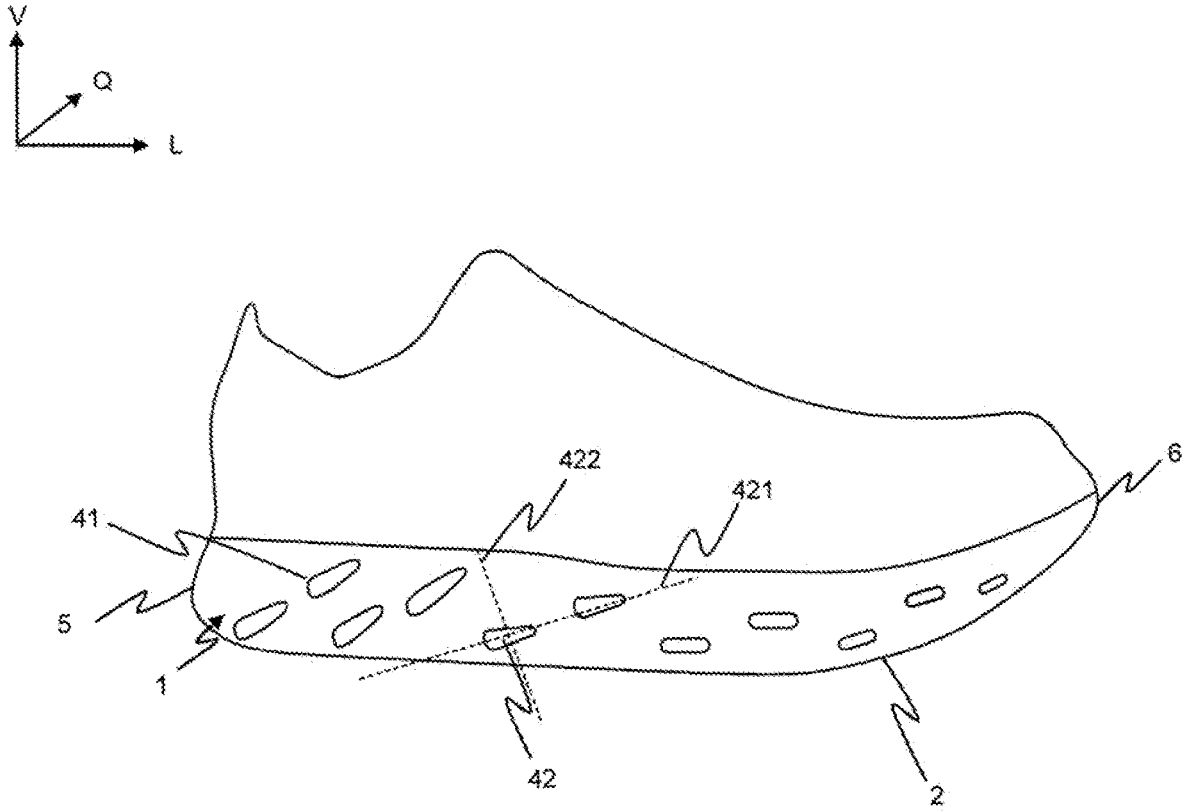
FIG. 8 shows a schematic side view of a shoe comprising a sole according to the invention for a running shoe according to a further embodiment of the invention.

A running shoe comprising a midsole 1 according to the invention according to a further embodiment of the invention is shown in FIG. 8. The main longitudinal axis 421 of the channel 42 extends in the V,L plane through the center point of the channel 42 and extends parallel to the longitudinal direction, i.e. the direction in which the channel extends. The main longitudinal axis additionally extends through the points of the channel walls, which are farthest apart from one another in the cross section along the above-mentioned cross-sectional plane. The channels are thereby arranged one behind the other in the longitudinal direction L from the heel edge 5 to the sole tip 6 and are arranged in at least a first and a second horizontal plane in the lateral and/or medial area of the midsole 1. The first and second horizontal plane are thereby formed vertically offset from one another. The channel 41 is thereby arranged in the first horizontal plane and the channel 42 is arranged in the second horizontal plane, which is arranged offset therefrom in the vertical direction.

The invention claimed is:

1. A sole for a running shoe comprising:

an elastic midsole (1) comprising a base surface (2), which delimits the midsole (1) opposite to a vertical direction (V) of the midsole, and a top surface (3), which delimits the midsole in the vertical direction (V), wherein the midsole (1) is divided into a heel area (FB), a midfoot area (MFB), and a forefoot area (VFB); and wherein the midsole (1) has several channels (41, 42, 43), which extend in a transverse direction (Q) of the midsole (1) and which are arranged one behind the other in a longitudinal direction (L) of the midsole (1), wherein the channels (41, 42, 43) each have an elongated contour in a cross-section along a cross-sectional plane in the longitudinal direction (L) of the midsole (1) and perpendicularly to the transverse direction (Q) of the midsole, and wherein each channel (41, 42, 43) has a main longitudinal axis (411, 421) in the cross-section along the cross-sectional plane in the longitudinal direction (L) and perpendicularly to the transverse direction (Q);

wherein an acute angle (α-41) between the main longitudinal axis (411) and the base surface (2) of at least one channel (41) arranged in the heel area is greater than an acute angle (α-42) between the base surface (2) and the main longitudinal axis (421) of at least one channel (42, 43) arranged in the midfoot area (MFB) and/or in the forefoot are (VFB);

wherein the channels in the heel area have a drop-shaped contour, wherein the drop-shaped contour comprises an isosceles triangle and a circular segment connected to the base of the triangle, wherein the base surface is located closer to the circular segment than the tip of the triangle;

wherein the acute angle (α-41) between the main longitudinal axis (411) and the base surface (2) of each channel first becomes greater from the channel (41) arranged closest to the heel edge (5) of the midsole from channel to channel in direction of the sole tip (6), and subsequently becomes smaller from channel to channel in the direction of the sole tip (6); and wherein the midsole comprises, in the heel area, a first channel, a second channel, and a third channel arranged consecutively from the heel edge of the midsole toward the sole tip, wherein the first channel is arranged closest to the heel edge of the midsole, and wherein the third channel is the channel of the midsole with the greatest acute angle between the main longitudinal axis and the base surface.

2. The sole according to claim 1, wherein the acute angle (α-41) between the main longitudinal axis (411) and the base surface (2) becomes continuously smaller from channel to channel from a channel in the heel area to a channel in the forefoot area.

3. The sole according to claim 1, wherein the acute angle between the main longitudinal axis and the base surface (2) of at least one channel (43) arranged in the forefoot area (VFB) is between 0° and 15°.

4. The sole according to claim 3, wherein the main longitudinal axis of all of the channels arranged in the forefoot area (VFB) is arranged essentially parallel to the base surface.

5. The sole according to claim 1, wherein each channel (41, 42, 43) has a main lateral axis (422) and wherein the height along the main lateral axis of a channel (43) arranged in the forefoot area (VFB) is smaller than the height along the main lateral axis (422) of a channel (41, 42) arranged in the midfoot area (MFB) and/or in the heel area (FB).

6. The sole according to claim 1, wherein the acute angle (α-41) between the main longitudinal axis (411) and the base surface (2) of a channel (41) arranged in the heel area (FB) is between 5° and 85°.

7. The sole according to claim 1, wherein the acute angle (α-42) between the main longitudinal axis (421) and the base surface (2) of a channel (42) arranged in the midfoot area (MFB) is between 0° and 35°.

8. The sole according to claim 1, wherein the channels (41, 42, 43) each have lateral openings on the lateral side and/or the medial side of the midsole (1).

9. The sole according to claim 8, wherein the midsole (1) and the channels (41, 42, 43) arranged in the heel area (FB) and/or in the midfoot area (MFB) and/or in the forefoot area (VFB) are configured to completely close the lateral openings by means of the forces occurring when running.

10. The sole according to claim 1, wherein the channels (41, 42, 43) in the forefoot area and part of the midfoot area each have a rectangular contour with rounded corners, in the cross section along the cross-sectional plane in the longitudinal direction (L) of the midsole (1) and perpendicularly to the transverse direction (Q) of the midsole (1).

11. The sole according to claim 1, wherein one or all of the channels (41) arranged in the heel area (FB) include a drop-shaped contour in the cross section along the cross sectional plane in the longitudinal direction (L) of the midsole (1) and perpendicularly to the transverse direction (Q) of the midsole (1).

12. The sole according to claim 1, wherein the channels (41, 42, 43) each have a width of 0.3 cm to 3 cm along the main longitudinal axis (411, 421).

13. The sole according to claim 1, wherein the channels (41, 42, 43) each have a height of 0.3 cm to 1.5 cm along the main lateral axis (422).

14. The sole according to claim 1, wherein for the channels in the heel area, the vertical distance between the respective channel and top surface of the midsole of each channel becomes smaller from the channel (41) arranged closest to the heel edge (5) of the midsole (1) from channel to channel in the direction of the sole tip (6).

15. The sole according to claim 1, wherein the vertical distance between the third channel and the top surface of the midsole is smaller than the vertical distance between any other channel of the midsole and top surface of the midsole.

16. The sole according to claim 1, wherein at least a portion of each of the channels of the midsole taper in the transverse direction from the lateral side to the medial side of the midsole, and/or wherein at least a portion of each of the channels of the midsole taper in the transverse direction from the medial side towards the lateral side of the midsole.

17. The sole according to claim 1, wherein at least a portion of the channels is configured that the channels assume an S-shape upon complete closure.

18. A running shoe, comprising the sole according to claim 1.

* * * * *